US005456742A

United States Patent [19]

Glenn et al.

[11] Patent Number: 5,456,742

[45] Date of Patent: Oct. 10, 1995

[54] ELECTRIC CIRCUIT HAVING A CONVENIENCE OUTLET FOR USE IN A HUMIDIFIER OR AN AIR PURIFIER

[75] Inventors: Neville R. Glenn, Milford; Jordan Kahn, Wellesley, both of Mass.

[73] Assignee: Holmes Products Corp., Milford, Mass.

[21] Appl. No.: 118,934

[22] Filed: Sep. 9, 1993

[51] Int. Cl.[6] ..... B03C 3/68

[52] U.S. Cl. ..... 96/26; 55/274; 96/63; 96/82; 261/70

[58] Field of Search ..... 96/26, 63, 80, 96/82; 55/274; 261/70; 361/225, 226, 231, 233

[56] References Cited

U.S. PATENT DOCUMENTS

| | | | |
|---|---|---|---|
| D. 242,459 | 11/1976 | Gerst | D23/364 |
| D. 288,597 | 3/1987 | Young | D23/356 |
| D. 307,936 | 5/1990 | Hirano et al. | D23/364 |
| 2,990,911 | 7/1961 | Lippincott | 96/26 |
| 3,495,381 | 2/1970 | Flanagan | 96/63 |
| 3,610,880 | 10/1971 | Kreiberg | 392/406 |
| 3,664,579 | 5/1972 | Foote | 236/44 R |
| 3,685,258 | 8/1972 | Kostel et al. | 96/63 |
| 3,738,088 | 6/1973 | Colosimo | 96/26 |
| 3,740,926 | 6/1973 | Duval | 96/26 |
| 4,318,152 | 3/1982 | Weber | 96/26 X |
| 4,344,776 | 8/1982 | Yavnieli | 96/63 |
| 4,376,642 | 3/1983 | Verity | 96/82 X |
| 4,692,593 | 8/1987 | Chiu | 219/399 X |
| 4,804,821 | 2/1989 | Glucksman | 392/390 |
| 5,016,296 | 10/1991 | Sengpiel et al. | 96/26 X |

*Primary Examiner*—Richard L. Chiesa
*Attorney, Agent, or Firm*—Kriegsman & Kriegsman

[57] ABSTRACT

An electric circuit is disclosed which includes an electric fan for dispersing air, a power switch for energizing the electric fan, and a convenience outlet for supplying power through the electric circuit to an external power consuming apparatus. The convenience outlet is operable separately and independently of the electric fan. In one embodiment for use in a humidifier the electric circuit further includes a refill light, a refill light switch, and a power light. In another embodiment for use in an air purifier the circuit further includes a filter sensor, a filter replacement indicator light, an ionizer for emitting ions, a negative ion switch, an ion indicator light and a power indicator light.

1 Claim, 4 Drawing Sheets

ELECTRIC CIRCUIT HAVING A CONVENIENCE OUTLET FOR USE IN A HUMIDIFIER OR AN AIR PURIFIER

BACKGROUND OF THE INVENTION

The present invention relates generally to an electric circuit and more particularly to an electric circuit which includes a convenience outlet. In one embodiment of the invention the electric circuit is constructed for use in a humidifier and in another embodiment of the invention the electric circuit is constructed for use in an air purifier.

Electric circuits having a convenience outlet for use in lamps are well-known in the art.

In U.S. Pat. No. 4,804,821 there is disclosed an aroma diffuser assembly that is provided with an electrical wire heating element for effecting the release of an aroma from a contained aroma producing material. Power is supplied to the heating element by a power supply assembly which has a first portion for electrical connection to an external power source and a second portion for supplying power from the external power source to other than the heating element. The power supply assembly is rotational within the aroma diffuser assembly to accommodate both vertical and horizontal orientations of a conventional household outlet as a source of power.

In U.S. Pat. No. 4,692,593 there is disclosed a domestic electric kiln which also can be used as an ordinary electric radiator and which is comprised of a heat resistant frame body with electric coils equipped around in its inner wall; a cover with an opening in its center; a safety lock on the other side of the cover; a water pipe for generating steam; a supporting plate which also facilitates the spreading of steam throughout the inner chamber; a shell with double walls which serves as an air-cooling mechanism and a temperature regulator. The device is characterized by continuous flow of both steam and hot air in the kiln chamber, thus, enabling one to make high quality products of chinaware or pottery by oneself at home.

In U.S. Pat. No. 3,664,576 there is disclosed a humidistat for controlling moisture conditions in a piano, cigar case, or any other small enclosure where moisture control is necessary. The humidistat is combined with a heating device or a dehumidifier and a moisture producing device or humidifier and includes a housing attached to a heater or dehumidifier either by the use of a snap-on connection or a permanent installation to facilitate mounting of the humidistat in proper relation to the enclosed area and the heater or dehumidifier and the moisture producing device or humidifier.

Other known references of interest include U.S. Pat. No. 3,610,880, U.S. Design Pat. No. 307,936, U.S. Design Pat. No. 288,597, and U.S. Design Pat. No. 242,459.

SUMMARY OF THE INVENTION

It is an object of the present invention to provide a new and improved electric circuit.

It is another object of the present invention to provide an electric circuit having a convenience outlet for use in a humidifier or an air purifier.

It is still another object of the present invention to provide an electric circuit as described above which further includes a power switch for energizing an electric fan, the power switch and the convenience outlet being separate and independently operable from each other.

It is still another object of the present invention to provide an electric circuit as described above which can be mass produced, has a minimal number of parts and can be easily assembled.

In accordance with the objects set forth above and hereafter made apparent from the description of the invention, an electric circuit constructed according to the teachings of the present invention is provided which comprises an electric fan, a power switch for controlling the operation of the electric fan and a convenience outlet operable separately and independently of the electric fan. In one embodiment for use in a humidifier, the circuit may further include a power light, a refill light, a refill light switch and a two setting fan speed switch. In another embodiment for use in an air purifier, the circuit may further include a filter sensor, a filter replacement indicator light, an electric ionizer, an ionizer switch, a power indicator light and an ion indicator light.

Additional objects, as well as features and advantages, of the present invention will be set forth in part in the description which follows, and in part will be obvious from the description or may be learned by practice of the invention. In the description, reference is made to the accompanying drawings which forms a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF DRAWINGS

The accompanying drawings, which are hereby incorporated into and consume a part of this specification, illustrate preferred embodiments of the present invention and, together with the description, serve to explain the principles of the invention. In these drawings wherein like reference numerals represent like parts.

DETAILED DESCRIPTION OF PREFERRED EMBODIMENTS

Figure 1:
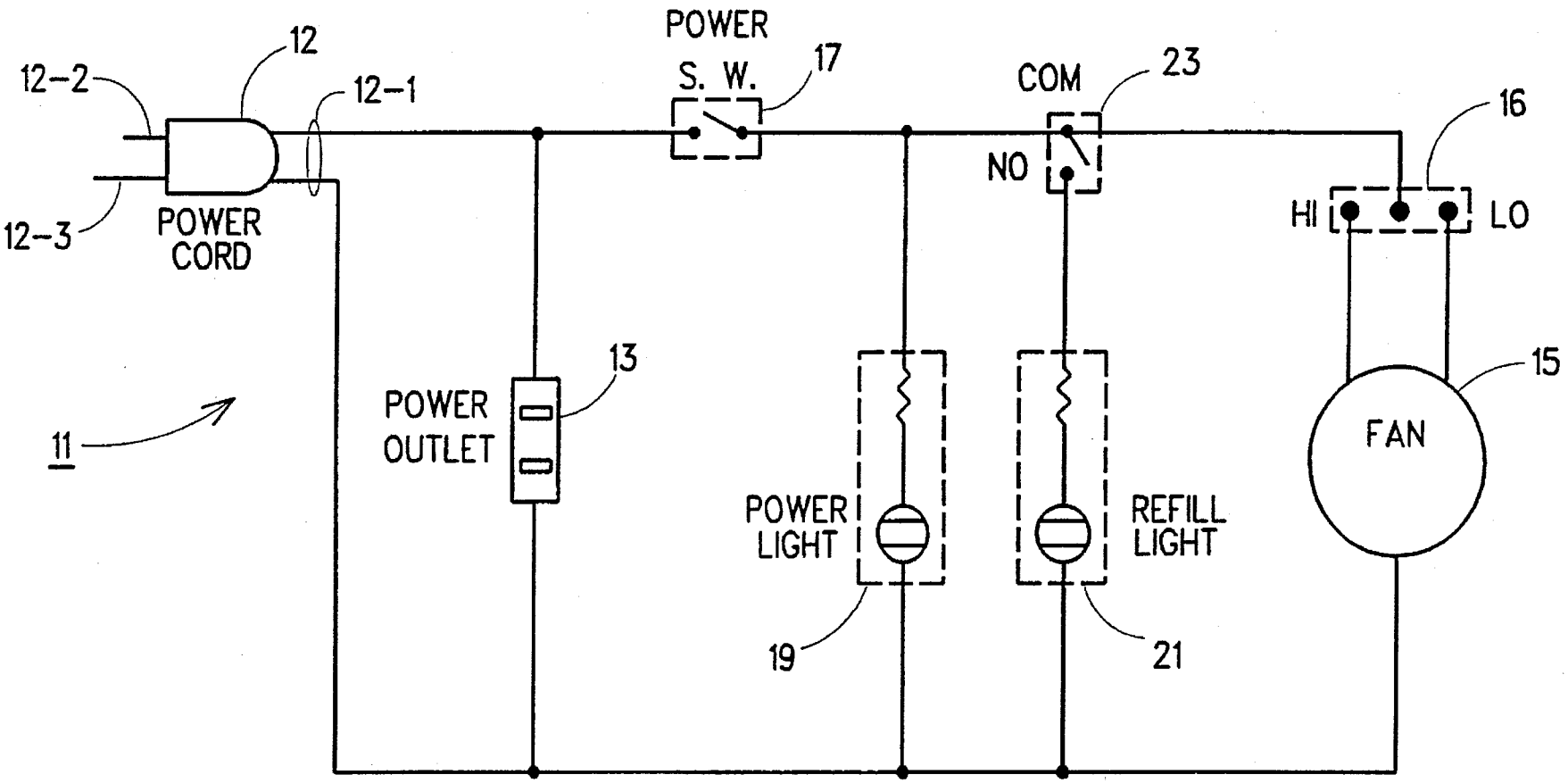
FIG. 1 is a schematic of one embodiment of an electric circuit constructed according to the teachings of the present invention.
Figure 2:
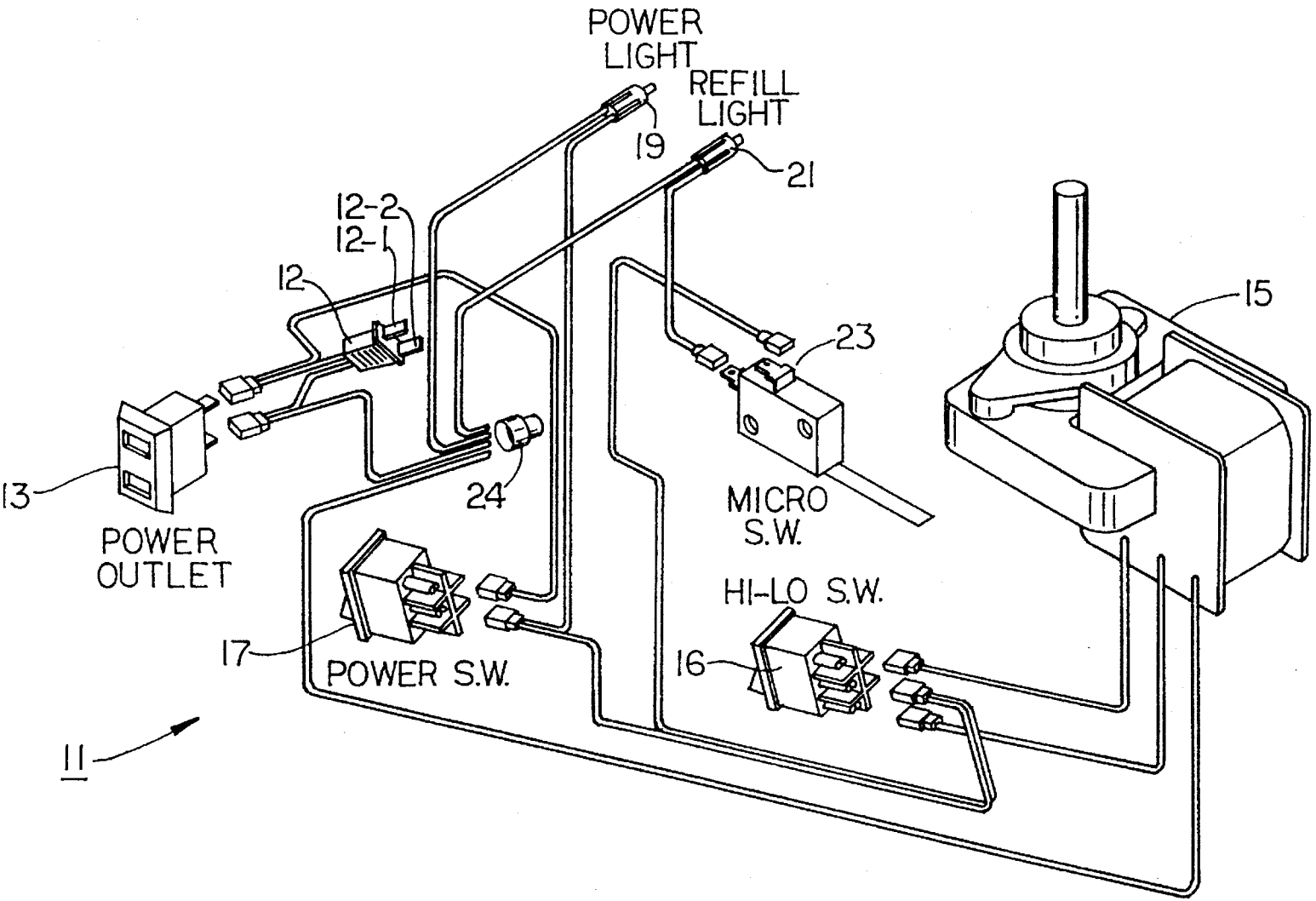
FIG. 2 is a hardware implementation of the electric circuit shown in FIG. 1.

Referring now to FIGS. 1 and 2, there is shown one embodiment of an electric circuit constructed according to this invention and being identified by reference numeral 11, electric circuit 11 being constructed for use in a wick-type humidifier.

Electric circuit 11 includes an input plug 12 attached to a power cord 12-1 for connecting circuit 11 to an electrical outlet (not shown) and an electric fan 15 to disperse humidified air. Plug 12 has a pair of poles 12-2 and 12-3. The speed of electric fan 15 is controlled by a high/low switch 16. An on/off power switch 17 is provided to control the flow of current to electric fan 15. Electric circuit 11 also includes a convenience outlet 13 which is operable independent of power switch 17 for supplying power through electric circuit 11 to an external power consuming apparatus (not shown).

Electric circuit 11 further includes a power light 19, a refill light 21 and a refill switch 23. Also shown in the FIG. 2 implementation is a solderless connector 24. Power light 19 is coupled in circuit 11 such that when power switch 17 is closed, current will pass through and illuminate power light 19.

Refill switch 23 is a normally open conventional float switch commonly used in humidifiers to monitor the water level. When the water surface in the tank of the humidifier (not shown) dips below a predetermined level, refill switch 23 will close causing current to pass through and illuminate refill light 21 indicating that the tank (not shown) needs to be refilled.

Figure 3:
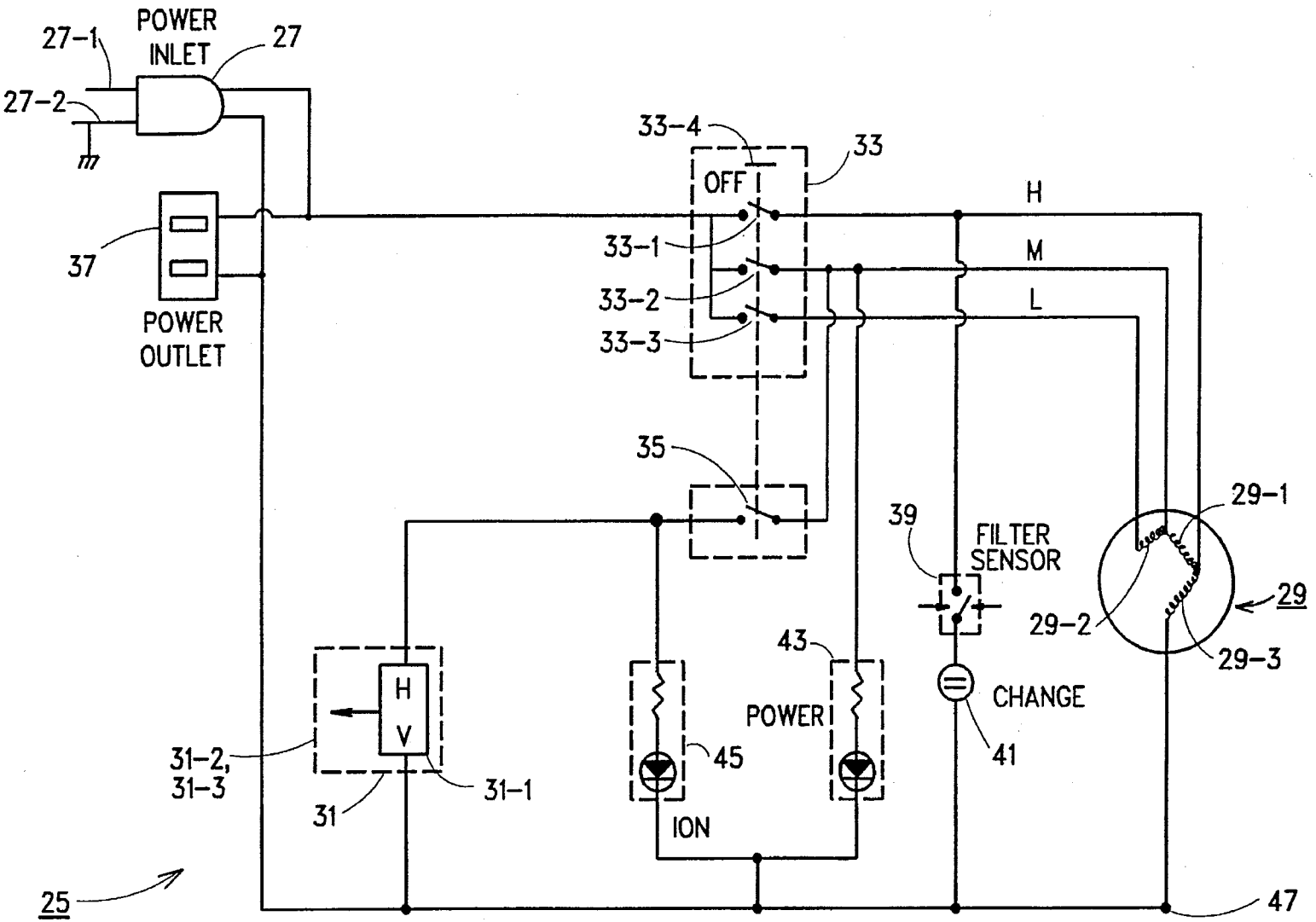
FIG. 3 is a schematic of another embodiment of an electric circuit constructed according to the teachings of the present invention.
Figure 4:
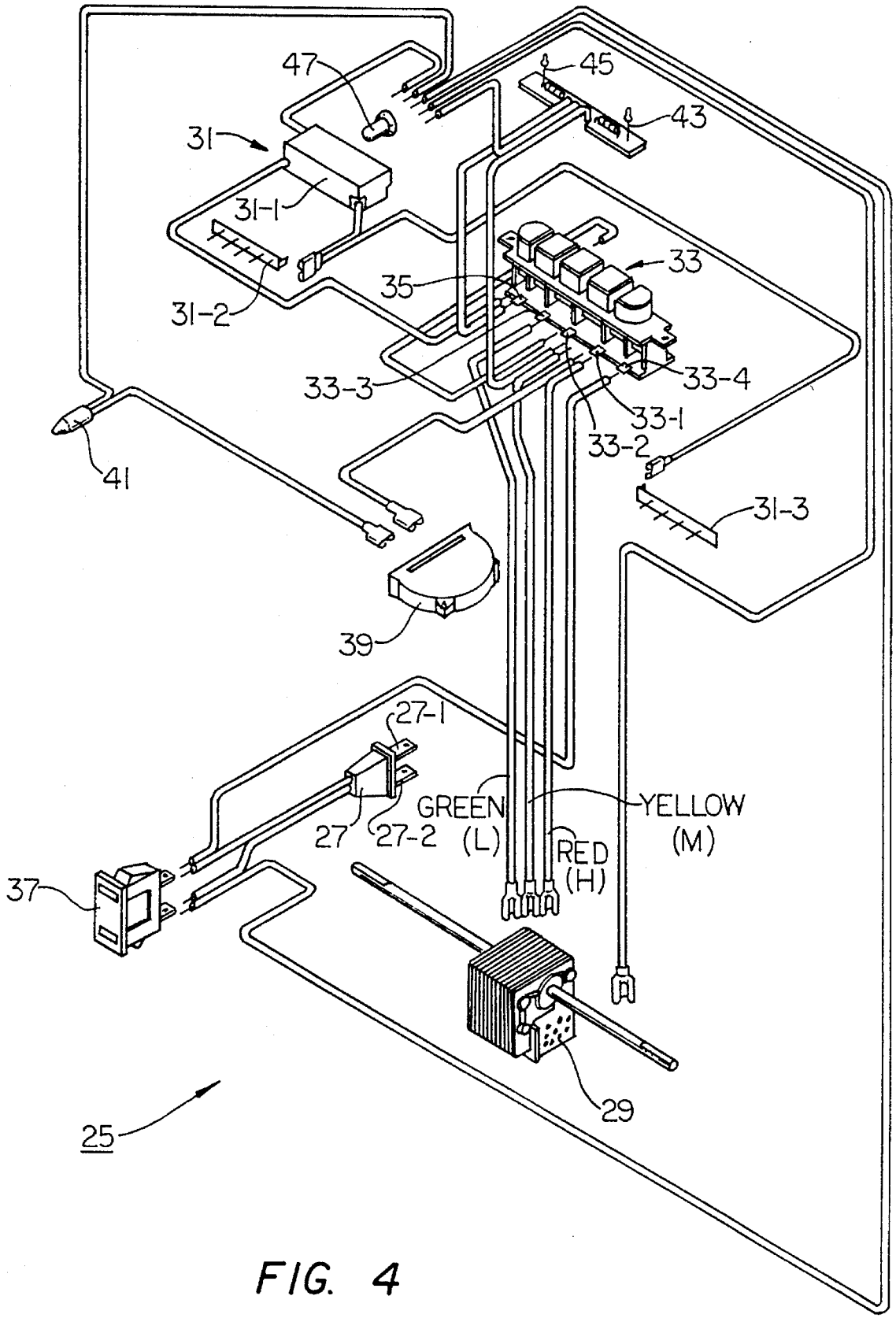
FIG. 4 is a hardware implementation of the electric circuit shown in FIG. 3.

Referring now to FIGS. 3 and 4, there is shown another embodiment of an electric circuit constructed according to this invention, the second embodiment representing an electric circuit designed for use in an air purifier (not shown) and being identified by reference numeral 25.

Electric circuit 25 includes an input plug 27 which may be connected to an outlet (not shown). Plug 27 has a pair of poles 27-1 and 27-2.

Electric circuit 25 also includes an electric fan 29 for drawing in impurified air and dispersing purified air, an electric ionizer 31 for producing negative ions, a power switch 33 for controlling the current applied to electric fan 29, an ionizer switch 35 for controlling the current applied to ionizer 31 and a convenience outlet 37 which is operable independent of power switch 33 for supplying power to an external power consuming apparatus (not shown). Power switch 33 includes four key type switches 33-1 through 33-4. When switch 33-1 is closed electric fan 29 will operate at high speed, when switch 33-2 is closed electric fan 29 will operate at medium speed and when switch 33-3 is closed electric fan 29 will operate at a low speed. Current will not flow through electric fan 29 unless one of the three switches 33-1, 33-2, or 33-3 is closed. Switch 33-4 is mechanically coupled to switches 33-1, 33-2 and 33-3 and is used to open switches 33-1, 33-2 and 33-3.

Electric ionizer 31 is comprised of a high voltage source 31-1 and two banks of needles 31-2 and 31-3.

Electric circuit 25 also includes a filter sensor 39, a filter replacement indicator light 41, a power "on" indicator light 43, an ion indicator light 45 and a solderless connector 47. Filter sensor 39 is a normally open switch which closes upon sensing a pressure differential in the filter (not shown) which is above a predetermined threshold. Therefore, when filter sensor 39 accumulates a large quantity of impurities, filter sensor 39 will react to the pressure differential by closing. Filter replacement indicator light 41 is used to indicate that the filter must be replaced.

Electric fan 29 includes three coil windings 29-1, 29-2 and 29-3 coupled together. Coil winding 29-1 is connected at one end to high switch 33-1 and at the other end to medium switch 33-2, coil winding 29-2 is connected at one end to medium switch 33-2 and at the other end to low switch 33-3, and coil winding 29-3 is connected at one end to high switch 33-1 and at the other end to solderless connector 47. As a result of the connection of the three switches 33-1, 33-2 and 33-3 through coils 29-1, 29-2 and 29-3, when any of switches 33-1 through 33-3 is closed, current will flow through and illuminate indicator light 43. Also, when any one of switches 33-1 through 33-3 is closed, and sensor 39 is closed, change light 41 will be illuminated.

When negative ionizer switch 35 and one of switches 33-1 through 33-3 are closed current will flow through ionizer 31 resulting in the emission of ions. In addition, the closing of negative ionizer switch 35 causes current to flow through and illuminate ion indicator light 45 indicating that ionizer 31 is being energized.

The embodiments of the present invention recited herein are intended to be merely exemplary and those skilled in the art will be able to make numerous variations and modifications to it without departing from the spirit of the present invention. For example it is considered to be within the skill of those of ordinary skill in the art to combine selected features of the embodiments described above in various different ways. All such variations and modifications are intended to be within the scope of the present invention as defined by the claims appended hereto.

What is claimed is:

1. An electric circuit for use in an air purifier, the circuit comprising:

a) a power cord, b) a plug attached to the power cord for connecting the electric circuit to an electrical outlet, c) an electric fan for dispersing air, d) a power switch for controlling the flow of current to the electric fan, e) a convenience outlet operable separately and independently of the electric fan and arranged for receiving current from the power cord regardless of the state of the power switch, f) a filter sensor for sensing the condition of a filter, g) a filter replacement indicator light for indicating the filter should be replaced, h) an ionizer for emitting negative ions, i) a negative ion switch, j) a power indicator light, and k) an ion indicator light.

* * * * *